US006089953A

United States Patent [19]

Chen

[11] Patent Number: 6,089,953

[45] Date of Patent: Jul. 18, 2000

[54] FRAGRANT BRASSIERE

[76] Inventor: Chin-Tang Chen, 5th Fl., No. 26, Kinghwa Street, Chungchen Dist., Taipei, Taiwan

[21] Appl. No.: 09/130,451

[22] Filed: Aug. 7, 1998

[51] Int. Cl.[7] ..... A41C 3/00

[52] U.S. Cl. ..... 450/1; 450/37; 450/57; 512/4; 239/36; 2/267; 2/1

[58] Field of Search ..... 2/1, 83, 46, 48, 2/49.1, 80, 247, 75, 248, 249, 704, 105, 250, 251, 106, 113, 114, 152, 252, 253, 73, 69, 400–409, 267; 450/53, 54–56, 57, 30–32, 38, 89; 239/36, 152, 153, 653; 512/1, 4

[56] References Cited

U.S. PATENT DOCUMENTS

| | | | |
|---|---|---|---|
| 4,744,514 | 5/1988 | Gadoua | 239/36 |
| 5,098,330 | 3/1992 | Greenberg | 450/57 |
| 5,334,082 | 8/1994 | Barker | 450/31 |
| 5,678,251 | 10/1997 | Getz | 512/4 |
| 5,679,052 | 10/1997 | Ruchi | 450/57 |
| 5,782,671 | 7/1998 | Suen | 450/38 |
| 5,823,432 | 10/1998 | Hogan | 239/36 |
| 5,823,852 | 10/1998 | Chu | 450/57 |
| 5,899,790 | 5/1999 | Berg | 450/1 |

*Primary Examiner*—G. Hale
*Attorney, Agent, or Firm*—Dougherty & Troxell

[57] ABSTRACT

A fragrant brassiere mainly including two pressure-resistant bags made of gas-pervious plastic material for sealing some kind of filler therein, and fragrance carriers containing a fragrant substance and being positioned in the filler inside the pressure-resistant bags. The filler is a substance allowing slow diffusion of fragrance in the bags. The diffused fragrance passes the gas-pervious plastic material of the bags to disperse in the air, making the brassiere having the pressure-resistant bags and the fragrance carriers send out fragrance for a prolonged time and therefore has longer useable life.

4 Claims, 5 Drawing Sheets

FRAGRANT BRASSIERE

BACKGROUND OF THE INVENTION

The present invention relates to an improvement made to a brassiere, and more particularly to an improvement made to a fragrant brassiere so that fragrance diffused from the brassiere lasts for a prolonged time while the brassiere is absolutely washable.

A brassiere is conventionally used by women only as a close-fitting support for their breasts. To make the brassiere look sexy, the brassiere cups usually have different shapes and decorative patterns. However, there are many new types of brassiere developed in recent years, such as a massaging brassiere that massages breasts to energize breast tissues and promotes breast development. Taiwanese Patent Publication Nos. 214038 and 308804 both disclose massaging brassiere of this type. More recently, there is developed a kind of fragrant brassiere that is said to have the effect of the currently popular fragrance cure and is widely welcomed by women. That is, fragrance is considered to have a positive influence on a person's normal glandular excretion and therefore a fragrant brassiere is helpful to a wearer's spiritual and physical health. Moreover, the fragrant brassiere has the function similar to perfume that has become a necessary and important item in women's dressing. To make such fragrant brassiere, fibers added with fragrant substance are usually used. A disadvantage of such fragrant brassiere is that the fragrance thereof can not last long. A fragrant brassiere might very possibly lose its fragrance after it is washed five or six times. In other words, the conventional fragrant brassiere has only a very short usable life and is therefore not economical from a consumer's viewpoint.

SUMMARY OF THE INVENTION

It is therefore a primary object of the present invention to provide a fragrant brassiere that is washable and has lasting fragrance.

To achieve the above object, the present invention mainly includes a pressure-resistant bag made of gas-pervious thin plastic material and filled with liquid, gel or other substance that enables diffusion of fragrance, and a fragrance carrier containing fragrant substance and being immersed in the filling liquid inside the pressure-resistant bag. The pressure-resistant bag is so designed that it has a shape suitable for positioning in a brassiere cup and serves as a cup pad. A wearer's body heat causes the fragrant substance contained in the fragrance carrier to gradually diffuse in the pressure-resistant bag and passes the gas-pervious plastic material thereof to disperse in the air. The fragrance sent out from the brassiere in this manner can last for a considerably long time and the fragrant brassiere can therefore have a prolonged usable life.

BRIEF DESCRIPTION OF THE DRAWINGS

A more complete understanding of these and other features and advantages of the present invention will become apparent from a careful consideration of the following detailed description of certain embodiments illustrated in the accompanying drawings, wherein.

DETAILED DESCRIPTION OF THE PREFERRED EMBODIMENTS

Figure 1:
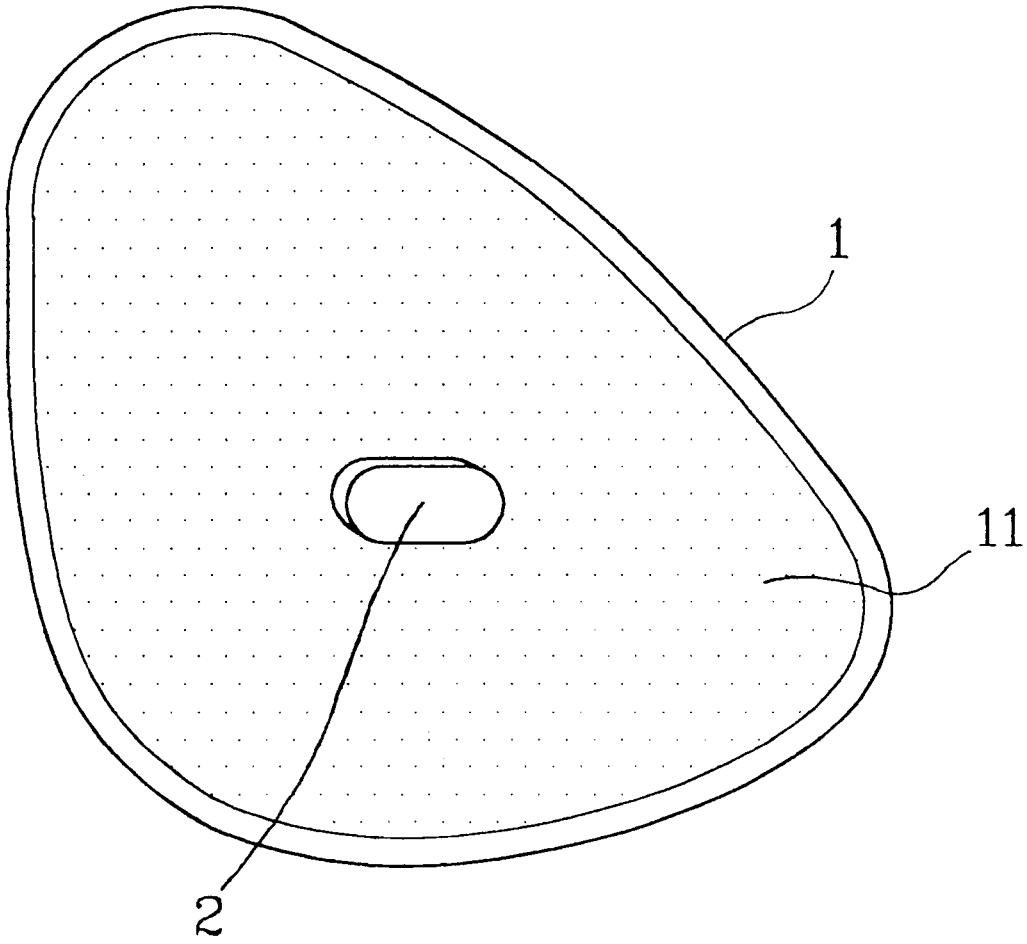
FIG. 1 illustrates a pressure-resistant bag having a fragrance carrier therein according to the present invention.
Figure 2:
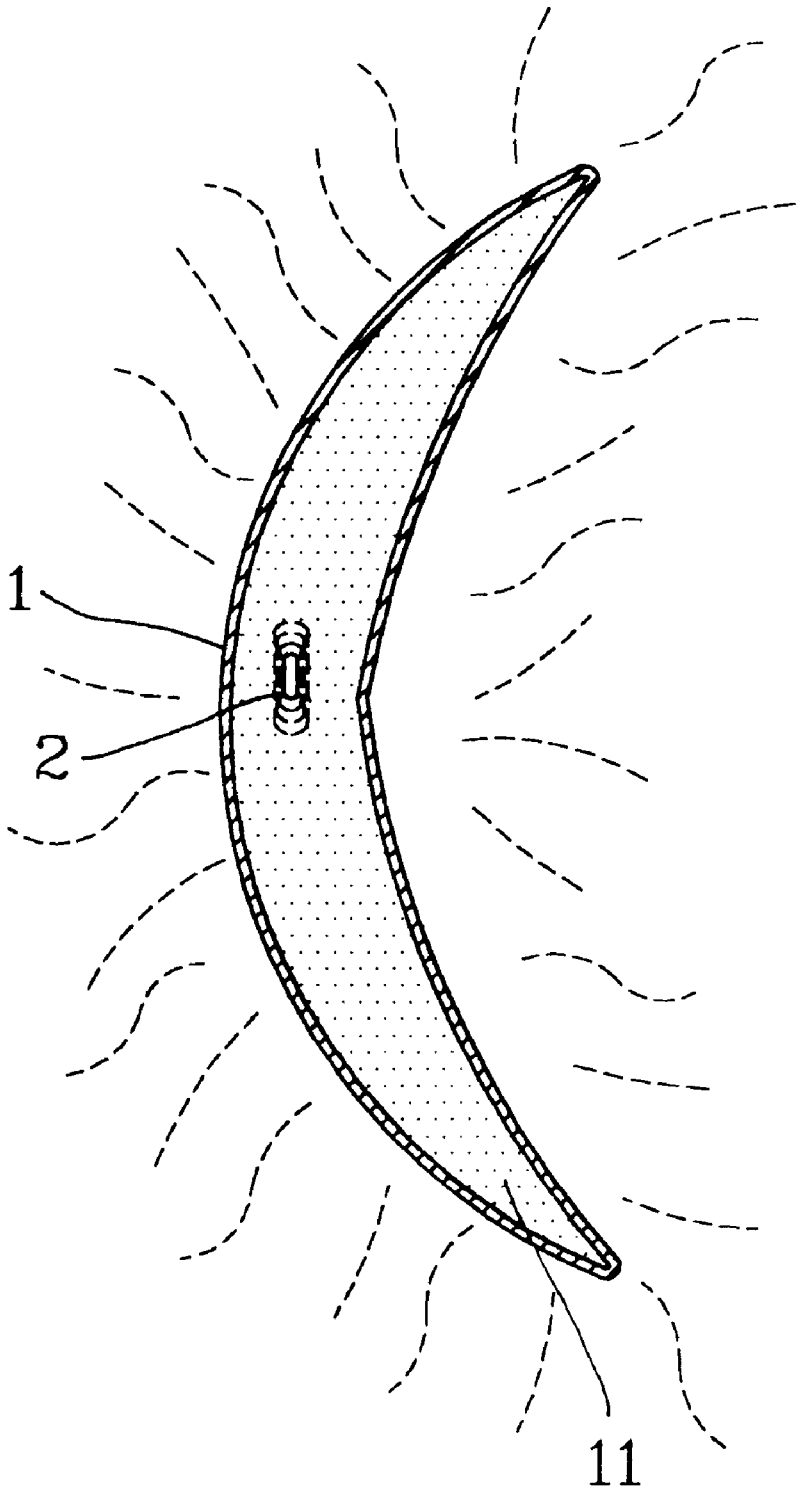
FIG. 2 is a sectional view of the pressure-resistant bag of FIG. 1.

Please refer to FIGS. 1 and 2. The present invention relates to an improvement made to a fragrant brassiere and mainly includes a pressure-resistant bag 1 and a fragrance carrier 2.

The pressure-resistant bag 1 is made of gas-pervious thin plastic material for sealing some kind of filler 11 therein. The filler 11 may be liquid, gelatinous material or any other filling substances allowing diffusion of a fragrant substance.

The fragrance carrier 2 contains a fragrant substance and is immersed in the filler 11 inside the pressure-resistant bag 1.

The fragrant substance contained in the carrier 2 gradually diffuses in the bag 1 and passes the gas-pervious plastic material of the bag 1 and disperses in the air. The gas-pervious thin plastic material forming the bag 1 permits only gas having tiny molecules to pass therethrough. For the filling liquid 11 having big molecules, it absolutely can not pass the plastic material in the same way as the diffused fragrant substance. Therefore, the bag 1 ensures that the fragrant substance slowly diffuses in the bag 1, allowing a brassiere 3 using the present invention to have lasting fragrant smell.

As shown in FIGS. 2 to 5, the bag 1 can be made into adequate shape for suitably positioning in a brassiere cup.

Figure 3:
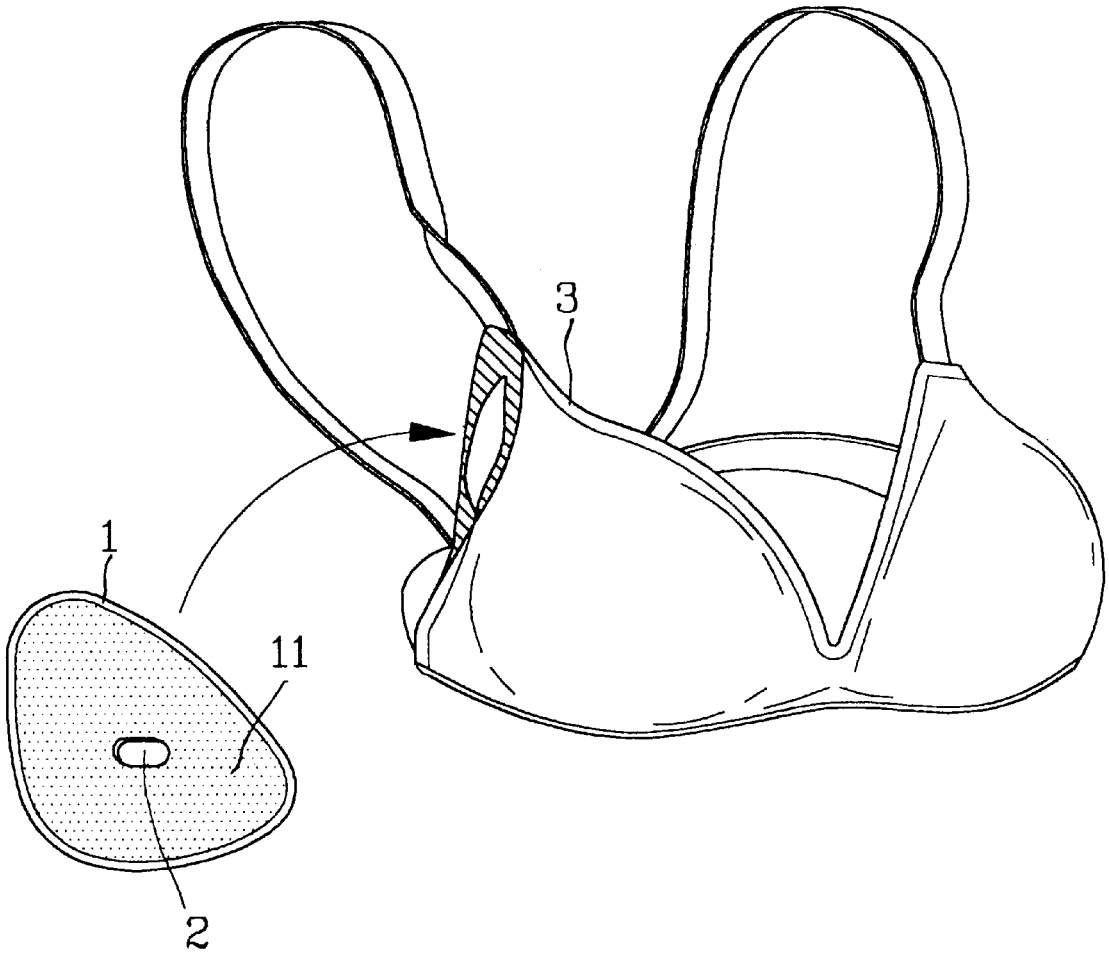
FIG. 3 illustrates the manner in which the pressure-resistant bag of the present invention is put into a brassiere cup.
Figure 4:
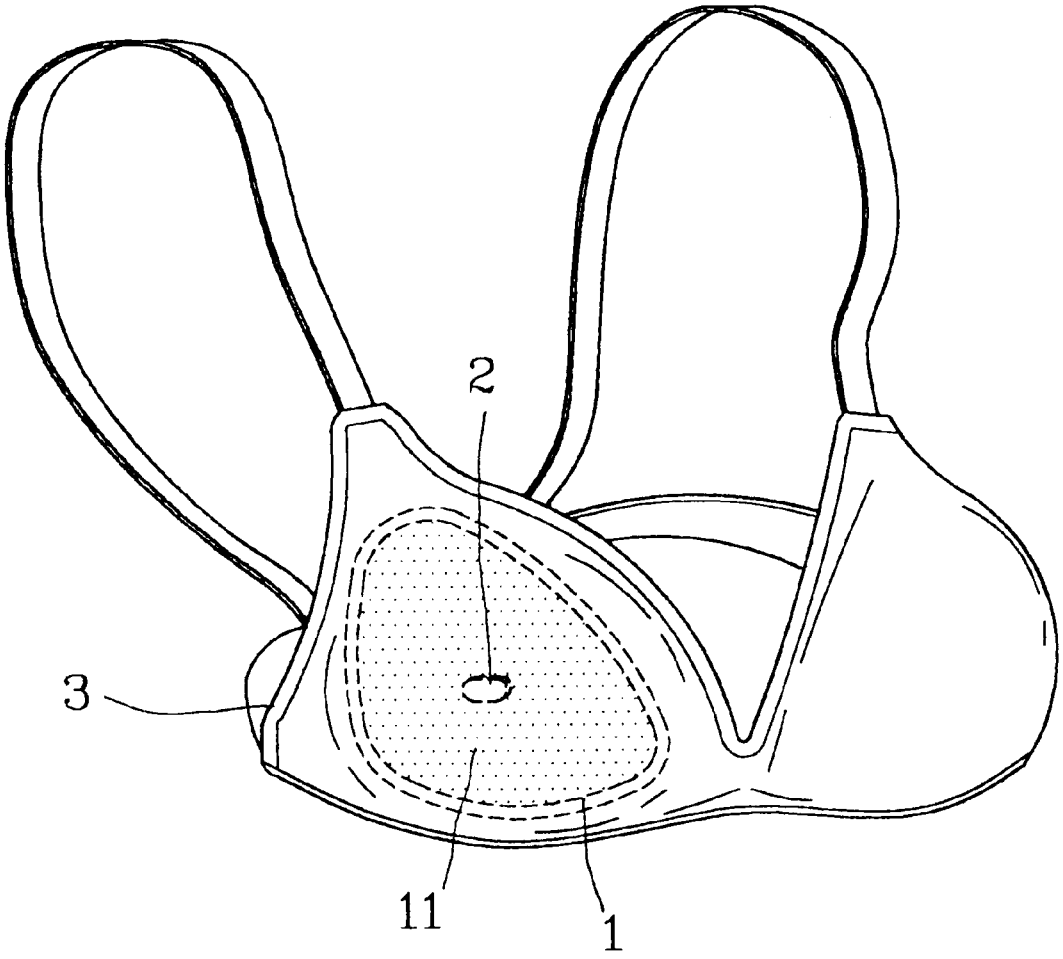
FIG. 4 illustrates a pressure-resistant bag of the present invention positioned in place in a brassiere cup.
Figure 5A:
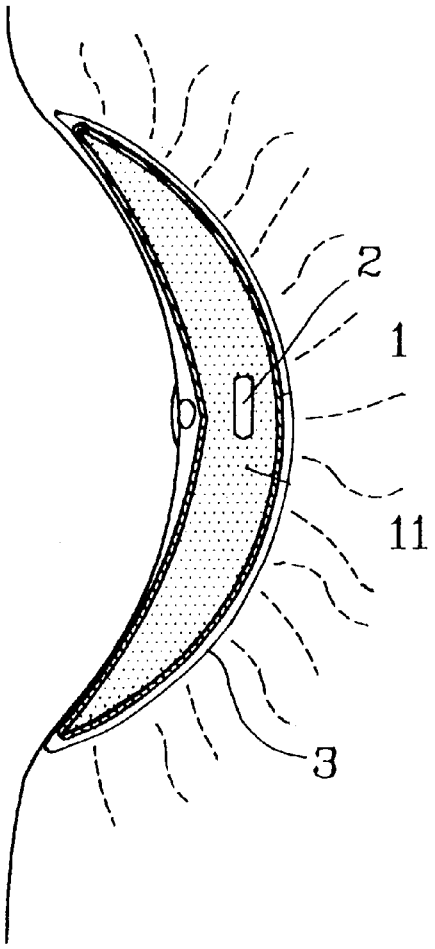
FIGS. 5A and 5B illustrate the present invention in use.
Figure 5B:
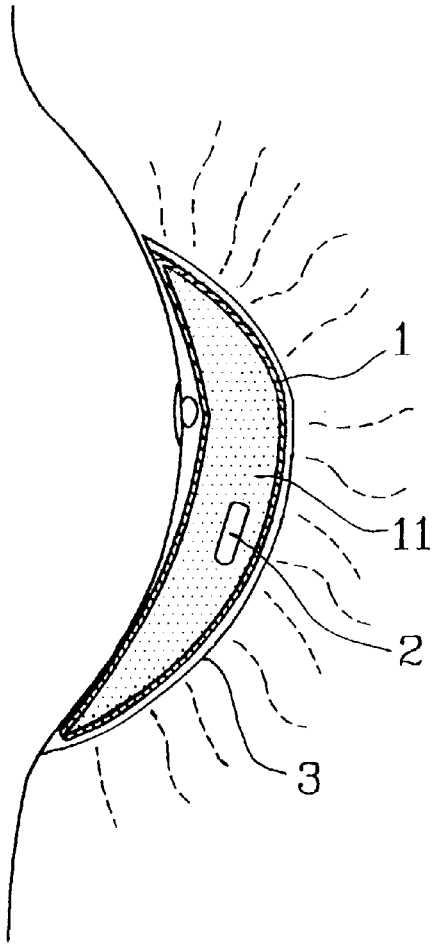

FIGS. 3 and 4 illustrate the manner in which the bag 1 of the present invention is positioned in a brassiere cup. FIGS. 5A and 5B illustrate the manner in which the fragrance carrier 2 in the bag 1 works to give out fragrance from the brassiere 3. Wherein, the fragrance carrier 2 can be made of gel doped with fragrant substance and is allowed to freely move in the filler 11 so as to produce vibrating waves in the bag 1 to gently massages a wearer's breast. The fragrance carrier 2 can be prepared according to adequate formulas to control the diffusivity thereof, such that when a brassiere 3 with the present invention is not worn by a user, the bag 1 is not subject to a high temperature and the fragrance carrier 2 will not diffuse too quickly. On the other hand, when the brassiere 3 is worn by a user, heat from the user's body causes the fragrance carrier 2 to diffuse fragrance into the filler 11 more quickly. The fragrance passes the gas-pervious thin plastic material of the bag 1 to disperse in the air. That is, the fragrance carrier 2 works in a manner similar to perfume but the fragrance it diffuses will last even longer than a conventional fragrant brassiere does.

Although the fragrance carrier 2 designed for the above-described embodiment is made of gelatinous material, any other material or structure that may ensure lasting fragrance, such as a gas-pervious plastic film wrap, a container with very fine pores, or a fragrance-adsorptive particles, can be employed to carry out the present invention. Moreover, different quantities of fragrance carriers 2 in different sizes may be contained in the bag 1 depending on a desired fragrance concentration and the time period for the fragrance to last.

With the above arrangements, the present invention may indeed allow a brassiere to diffuse fragrance for an even longer time while the brassiere provides massage effect through vibrating waves in the brassiere cups caused by the movable fragrance carrier 2 in the bag 1. Moreover, fragrance diffused from the carrier 2 also has the effect of fragrance cure on the wearer.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A fragrant brassiere comprising:

two brassiere cups;

two pressure-resistant bags made of gas-pervious thin plastic material and being provided therein with filling substance that allows diffusion of fragrance, said pressure-resistant bags being separately positioned in said two brassiere cups; and fragrance carriers containing a fragrant substance and being movably positioned in said filling substance inside said pressure-resistant bag;

whereby said fragrant substance contained in said fragrance carriers diffuses fragrance at a predetermined rate and said fragrance diffused from said fragrance carriers passes said gas-pervious plastic material of said bag to disperse in the air, making said fragrant brassiere send out fragrance for a prolonged time.

2. A fragrant brassiere as claimed in claim 1, wherein said pressure-resistant bags have a shape suitable for positioning in said brassiere cups.

3. A fragrant brassiere as claimed in claim 1, wherein said filling substance provided in said pressure-resistant bags are selected from the group consisting of liquid, or gelatinous material, allowing diffusion of fragrance therefrom.

4. A fragrant brassiere as claimed in claim 1, wherein said fragrance carriers are selected from the group consisting of gel, gas-pervious thin plastic coating, a container having very fine pores, and essence-adsorptive particles; and wherein said pressure-resistant bags elastically contain different quantities of said fragrance carriers in different sizes depending on a desired fragrance concentration and a time period for said fragrance to last.

* * * * *